United States Patent [19]

Richlen

[11] Patent Number: 4,840,226

[45] Date of Patent: Jun. 20, 1989

[54] CORROSIVE RESISTANT HEAT EXCHANGER

[75] Inventor: Scott L. Richlen, Annandale, Va.

[73] Assignee: The United States of America as represented by the United States Department of Energy, Washington, D.C.

[21] Appl. No.: 83,340

[22] Filed: Aug. 10, 1987

[51] Int. Cl.[4] ..... F28F 19/00

[52] U.S. Cl. ..... 165/134.1; 165/155

[58] Field of Search ..... 165/134.1, 155; 60/753, 60/757

[56] References Cited

U.S. PATENT DOCUMENTS

| | | | |
|---|---|---|---|
| 3,440,818 | 4/1969 | Quillevere et al. | 60/753 |
| 3,981,142 | 9/1976 | Irwin | 60/753 |
| 4,173,615 | 11/1979 | Otsuka et al. | 422/197 |
| 4,365,543 | 12/1982 | Baker | 98/58 |
| 4,695,247 | 9/1987 | Enzaki et al. | 431/352 |

FOREIGN PATENT DOCUMENTS

| | | | |
|---|---|---|---|
| 56-100233 | 8/1981 | Japan | 60/753 |

*Primary Examiner*—Samuel Scott
*Assistant Examiner*—Allen J. Flanigan
*Attorney, Agent, or Firm*—Gustavo Siller; Helen S. Cordell; William R. Moser

[57] ABSTRACT

A corrosive and errosive resistant heat exchanger which recovers heat from a contaminated heat stream. The heat exchanger utilizes a boundary layer of innocuous gas, which is continuously replenished, to protect the heat exchanger surface from the hot contaminated gas. The innocuous gas is conveyed through ducts or perforations in the heat exchanger wall. Heat from the heat stream is transferred by radiation to the heat exchanger wall. Heat is removed from the outer heat exchanger wall by a heat recovery medium.

16 Claims, 3 Drawing Sheets

CORROSIVE RESISTANT HEAT EXCHANGER

CONTRACTUAL ORIGIN OF THE INVENTION

The United States Government has rights to this invention pursuant to Contract No. DE-AC07-76ID01570 between the United States Department of Energy and EG&G Idaho, Inc.

BACKGROUND OF THE INVENTION

The present invention relates generally to a corrosive and erosive resistant heat exchanger and more particularly to a heat exchanger which utilizes a boundary layer of innocuous gas which is continuously replenished, to protect the surface of the heat exchanger walls from contaminated or corrosive gases.

A heat exchanger, which is capable of recovering heat from a high temperature contaminated or corrosive stream is needed in several industrial and research applications.

Blast furnace stoves, used in the steel industry, are regenerative heat exchangers which are used to heat the blast air supplied to a blast furnace. These stoves include a combustion chamber in which a fuel, typically coke oven gas, is burned with air to provide a heat source. The exhaust stream from the combustion chamber is passed through a matrix of ceramic refractory tiles which absorb heat from the gas stream. The combustor is then shut off and blast air is passed through the tiles, absorbing the stored heat.

Glass melting furnaces use the heat from exhaust gas to preheat the combustion air and sometimes the fuel. Exhaust gas leaving the furnace is passed through ceramic refractory tiles which absorb heat from the waste stream. Heat is then transfered from the tiles to the combustion air or fuel.

Aluminum remelt furnaces use the heat from exhaust gas to preheat the combustion air. Exhaust gas leaving the furnace is passed through stack type or shell and tube type metal heat exchangers where the heat from the exhaust gas is transferred from the gas through a separating metal wall to preheat combustion air.

The exhaust streams of the blast furnace stoves, glass melting furnaces and aluminum remelt furnaces may be highly corrosive and/or erosive. Although ceramic refractory tile materials are somewhat effective against the corrosive and erosive combustion products in either the blast furnace or the glass melting furnace, there are several disadvantages to the use of these materials. Ceramic materials are expensive, particularly when used in large industrial-scale applications. Additionally, ceramic materials cannot be easily formed into large or exotic shapes. If a large diameter duct is needed, it cannot be extruded from a ceramic material. Rather, the duct must be made of a matrix of individual ceramic tiles. Metal ducts or walls can be easily fabricated by an extrusion process. However, as often occurs in metal heat exchangers installed on aluminum remelt furnaces, a metal wall is rapidly corroded by such heat streams.

Magnetohydrodynamic (MHD) technology is another area in which a need exists for a corrosive resistant heat exchanger. The performance requirements of a heat exchanger used in recuperating heat from a MHD waste stream, exceed the requirements of the blast furnace stove, glass furnace or aluminum remelt furnace heat exchangers. First, the temperatures of both the heating gas (approximately 3,000° F.) and the heated gas are substantially higher for the heat exchangers used in MHD applications. Second, the relatively large concentrations of coal ash and seed compounds, such as potassium and cesium, in the MHD gas in conjunction with the high temperature, make the waste stream much more corrosive and erosive than the combustion products in a blast furnace, a glass melting furnace or aluminum remelt furnace. These conditions may have deleterious effects even on ceramic materials.

U.S. Pat. No. 4,365,543, issued to Maurice R. Baker, discloses an arrangement which may be useful in protecting the walls of a duct from a corrosive stream. In the Baker arrangement, a corrosive waste gas is maintained separate from the structural wall of a chimney or duct by a continuous jacket of air which moves along with the waste gas. The air forming the protective jacket is introduced into the duct through inlets around the perifery of the duct. Rings, supported by ribs, are provided at spaced intervals near the inner surface of the duct. The rings prevent the air from drifting radially inward, thereby forming a protective air layer between the duct wall and the waste stream.

The arrangement disclosed by the Baker patent, however, may not be suitable for the industrial or MHD applications discussed above. The rings in the Baker arrangement are themselves in direct contact with the waste stream. A hot corrosive or erosive waste stream would have the same effect on the ring material as on a duct wall. Additionally, the ring arrangement may not be sufficient to prevent a turbulent waste stream from mixing with the protective air layer. Thus, the ring arrangement may not be effective in preventing corrosive waste stream particles from impinging on the duct walls, if the waste stream flow is turbulent. Further, frictional drag between the air and the wall will cause the protective air layer to decay after a given length of duct. The length of the heat exchanger duct is therefore limited in this arrangement.

Therefore, in view of the above, it is an object of the present invention to provide a corrosive and erosive resistant heat exchanger.

It is another object of the present invention to provide a heat exchanger capable of recovering heat from a hot corrosive waste gas stream.

It is still another object of the present invention to provide a heat exchanger in which a hot corrosive waste stream is prevented from contacting the heat exchanger walls.

Additional objects, advantages, and novel features of the invention will become apparent to those skilled in the art upon examination of the following or may be learned by practice of the invention. The objects and advantages of the invention may be realized and obtained by means of the instrumentalities and combinations particularly pointed out in the appended claims.

SUMMARY OF THE INVENTION

To achieve the foregoing and other objects in accordance with the purposes of the present invention, as embodied and broadly described herein, the heat exchanger of this invention may comprise a conduit for conveying a hot corrosive and/or contaminated gas from which heat is recovered. Ducts are provided through the conduit walls, at predetermined spaced intervals in both the longitudinal and horizontal directions. Means are provided for conveying an innocuous gas through the ducts into the conduit carrying the hot gas. The innocuous gas forms a protective boundary layer between the walls of the conduit and the hot corrosive gas stream. means are provided for recovering the heat which is transferred by radiative heat exchange from the gas stream to the conduit walls.

DETAILED DESCRIPTION OF THE INVENTION

Figure 1:
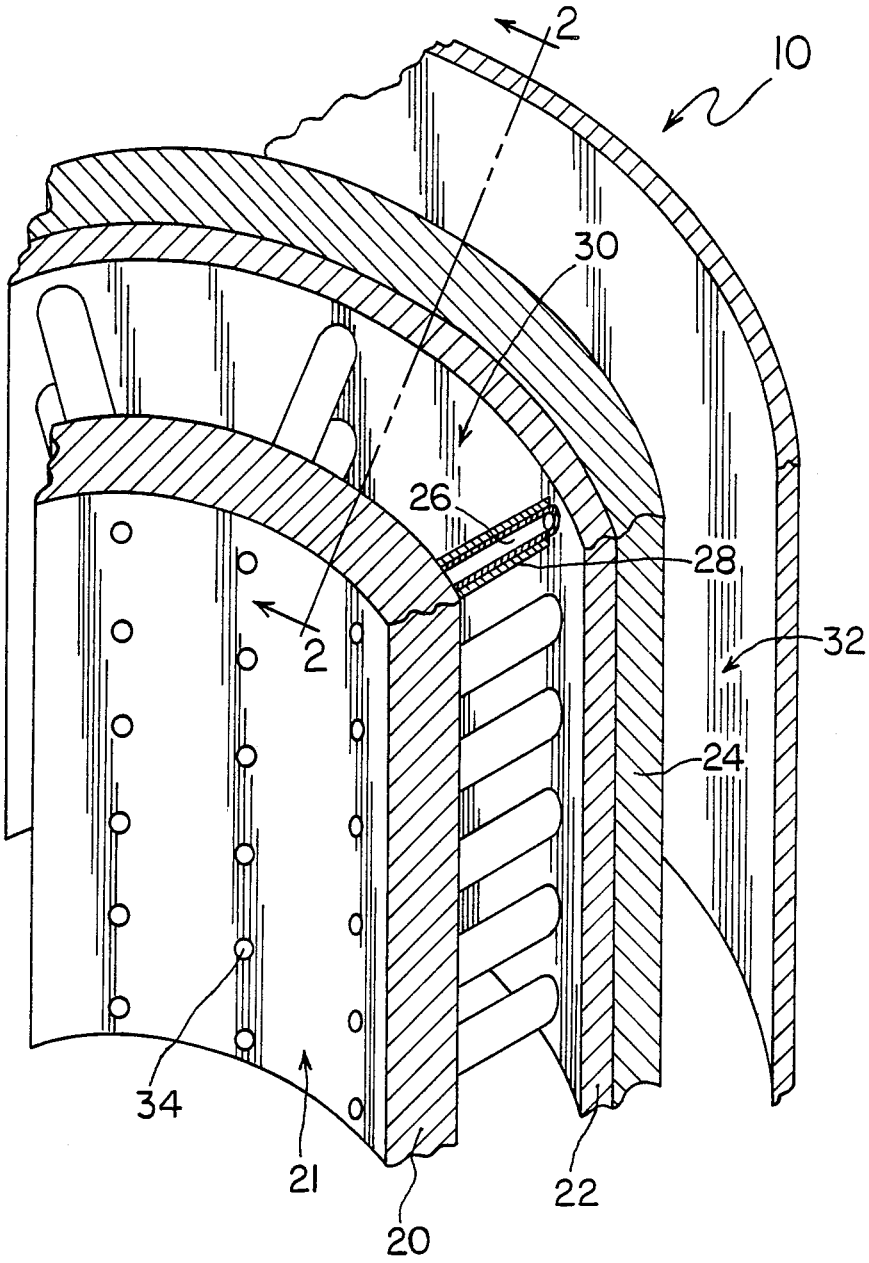
FIG. 1 is a generally schematic fragmentary view of the heat exchanger of the present invention.
Figure 2:
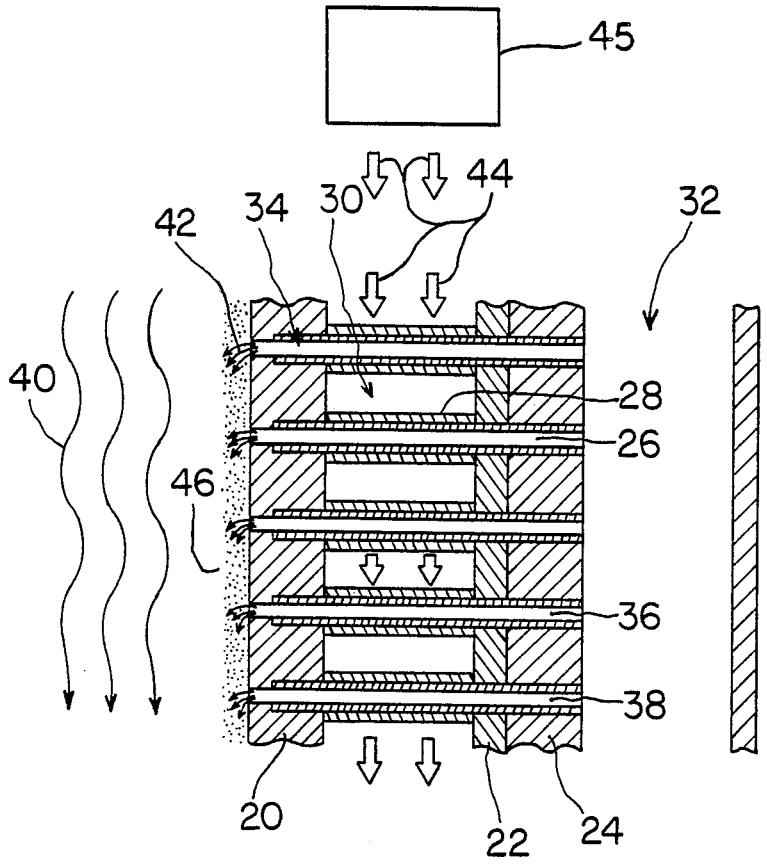
FIG. 2 is a fragmentary view of the heat exchanger of the present invention through line 2—2 of FIG. 1.

In accordance with the present invention, a heat exchanger is disclosed for recovering heat from a hot corrosive or erosive heat stream. The heat exchanger is illustrated in FIGS. 1 and 2. The following description of the preferred embodiment of the present invention is made with reference to a conduit with a circular cross-section. It will be readily apparent to those skilled in the art that any suitable cross-section may also be used.

A tubular conduit is formed by a first wall 20 which transports a hot contaminating (fouling) or attacking (corroding) heat stream, represented by the curved arrows 40. The heat exchanger wall forms conduit 21 and has perforations or ducts 34. These ducts provide a passage for the flow of an innocuous transparent gas to the inner surface of conduit 21. An innocuous gas is defined here as a gas which will be relatively inactive with either the waste stream gas or the wall material. As discussed below, the gas must also be transparent to radiative heat transfer. The innocuous gas, represented by arrows 42, acts as a chemically protective boundary layer, represented by shaded area 46, on the heat exchanger surface. The boundary layer isolates the surface of conduit 21 from the constituents of the heat stream 40, from which heat exchanger 10 is extracting heat. This isolation prevents the stream constituents from contaminating or corroding the heat exchanger walls.

The boundary layer is replenished, as needed, through ducts 34 positioned at appropriately spaced intervals. The ducts 34 are shaped, sized, and positioned to provide the most efficient (i.e. isolating) boundary layer using the minimum quantity of boundary layer constituent gas.

Although in the preferred embodiment air is used as the protective gas, it will be readily apparent to those skilled in the art that any transparent, innocuous gas may be effectively used in the present invention.

Boundary layer 46, while isolating the surface of conduit 21 from the constituents of heat stream 40, is transparent to radiative heat which propagates through the boundary layer gas and is absorbed by the heat exchanger surface of wall 20. Although the boundary layer 46 prevents convective heat transfer to the heat exchanger surface 20, the performance of heat exchanger 10 is not significantly degraded. The heat exchanger is applied to high temperature heat streams in which radiative heat exchange is significantly greater than convective heat exchange. Therefore, the boundary layer gas must be transparent to radiative heat transfer from the heat stream.

The boundary layer protection provided by the present invention allows the use of materials in the heat exchanger wall which would ordinarily fail in a heat exchanger without such boundary layer protection. The material used for the walls of conduit 21 need not be inert to the exhaust gas. Materials such as carbon-steel, stainless steel or metallic alloys, which can be easily extruded into large ducts may be used. For a heat exchanger with optimum corrosion protection, ceramic materials may be used for the walls.

The heat, which is recuperated from heat stream 40, propagates through the wall of conduit 21 by conduction. The heat is then transfered to a secondary medium which transports the heat, as in a typical heat exchanger. The transporting medium may be any suitable liquid or gas.

Preferably, the medium for recovering the heat, represented by arrows 44, is introduced by pumping means 45 and is passed through a first plenum 30. A second cylindrical surface forms the outer wall 22 of plenum 30, with the outer surface of conduit 21 forming the inner wall. The outer cylindrical wall 22 may have ducts 36 which are connected to ducts 34 by tubes 26. The innocuous gas forming boundary layer 46, is sequentially conveyed through ducts 36, tubes 26, and ducts 34. The innocuous gas must be conveyed through ducts 36 at a pressure and rate sufficient to assure that protective boundary layer 46 will be formed on the inner surface of wall 20.

Insulting material 28 is disposed around tubes 26 to minimize the heat transfer from the heat recovery medium 44 to the innocuous gas passing through the tubes.

Insulating material 24 is disposed around cylindrical wall 22 to minimize the heat loss from the heat recovery medium 44 in plenum 30. The insulating material 24 has perforations 38 which are aligned with ducts 36.

Any appropriate means may be used to convey the innocuous gas into ducts 36 in order to generate and replenish the protective boundary layer 46. Preferrably, the gas is conveyed by means of a second plenum 32. The plenum 32 must contain the innocuous gas at a pressure sufficiently high to assure that the gas will flow into conduit 21 and form boundary layer 46.

The mass flow rate, m, of the injected innocuous gas which is required to maintain and replenish the boundary layer can be calculated by those skilled in the art from the available literature. In particular, P. A. Libby et al., Phys. Fluids, 8, 568 (1965), obtain a two dimensional solution for the velocity distribution in a laminar boundary layer with a uniform external stream.

The dimensions and parameters of a typical radiant recuperator (heat exchanger) are given below in TABLE 1.

TABLE 1

| | | |
|---|---|---|
| Length | 28 ft. | |
| Flue Dia. | 3.17 ft. (exhaust gas) | |
| Annulus thickness | 0.062 ft. (preheat air) | |
| PROCESS CONDITIONS | | |
| | Flue Gas | Preheat Air |
| Mass Flow Rate (lb/hr) | 6951 | 6600 |
| Inlet Temperature (°F.) | 2000 | 70 |
| Outlet Temperature (°F.) | 1313 | 975 |

The flue gas Reynolds Number is given by $$Re_{fg} \frac{OVD}{\mu} = \frac{m\,D}{A\mu}$$

-continued where $Q$ = volumetric flow rate $V$ = flue gas velocity $D$ = flue tube diameter $\mu$ = viscosity coefficient $m$ = mass flow rate $A$ = area of flue tube The $Re_{fg}$ for a recuperator with the dimensions given in TABLE 1 is given below for various typical temperatures.

| | |
|---|---|
| $Re_{fg}$ (Tavg.) = | 24,900 |
| $Re_{fg}$ (T = 2000° F.) = | 22,500 |
| $Re_{fg}$ (T = 1300° F.) = | 27,800 |

L/D=8.83 for a heat exchanger with the dimensions given in TABLE 1. The flow is not developed and will be similar to that of a flat plate. The Reynolds Numbers indicate that the flow is turbulent, but can be approximated by laninar flow.

Libby et al. provide a curve of $$\frac{K_{iw} - K_{ie}}{K_{ic} - K_{ie}} \text{ VS. } \frac{(\rho V)_w}{(\rho V)_e} \sqrt{\frac{\rho_e V_e X}{\mu_e}}$$

where:

$K$ = concentration of ith component $e$ = free stream $w$ = wall $c$ = injected stream $\rho$ = density of the gas $X$ = distance edge of plate The values for several points on this curve are given below in TABLE 2.

TABLE 2

| $\frac{K_{iw} - K_{ie}}{K_{ic} - K_{ie}}$ | $\frac{(\rho V)_w}{(\rho V)_e} \sqrt{\frac{\rho_e V_e X}{\mu_e}}$ |
|---|---|
| 0.20 | 0.09 |
| 0.40 | 0.21 |
| 0.60 | 0.34 |
| 0.80 | 0.51 |
| 0.85 | 0.56 |
| 0.90 | 0.60 |
| 0.95 | 0.80 |

For a heat exchanger with the parameter given in TABLE 1

$$(\rho V)_e = \frac{m}{A} = \frac{6951 \text{ lb/hr}}{\frac{\pi (3.17 \text{ ft.})^2}{4}} = 881 \text{ lb/ft. 2 hr.} \quad (1)$$

At a point X down conduit 20

$$Re_{ex} = \frac{(\rho V)_e}{\mu_e} X = \frac{(881 \text{ 16/ft. 2 hr.})(X \text{ ft})}{(3.12 \times 10^{-5} \text{ lb/ft. sec})(3600 \text{ sec/hr})} = 7841\, X \quad (2)$$

Consider a point along the length of conduit 20 where $K_{iw}/K_{ie}=0.1$, that is a point along the length of conduit 21 where the concentration of the corrosive substance at the wall is 10% that in the free stream. Assuming that no corrosive component is injected through the innocuous gas then $K_{ic}=0$ and $$\frac{K_{iw} - K_{ic}}{K_{ic} - K_{ie}} = 1 - (K_{iw}/K_{ie}) \quad (4)$$

$$\text{For } K_{iw}/K_{ie} = 0.1, \frac{K_{iw} - K_{ie}}{K_{ic} - K_{ie}} = 1 - 0.1 = 0.9$$

At this point it can be seen from TABLE 2 that $$\frac{(\rho V)_w}{(\rho V)_e} \sqrt{\frac{\rho_e V_e X}{\mu_e}} = 0.6 \quad (3)$$

The injection rate of innocuous gas required to form boundary layer 46, for a maximum corrosive gas concentration of 10% can be approximated by assuming that this maximum concentration will occur at the downstream end of conduit 21. From equation 3

$$\frac{(\rho V)_w}{(\rho V)_e} \sqrt{Re_{ex}} = 0.6$$

$$(\rho V)_w = (0.6)\,(\rho V)_e / \sqrt{Re_{ex}}$$

Substituting in the values from equations 1 and 2, $$(\rho V)_w = (0.6)(881 \text{ lb/ft.}^2\text{-hr.})/\sqrt{7841\, X} = 5.97/\sqrt{X} \quad (5)$$

For the boundary layer 46

$$\dot{m}_w/A = \dot{m}_w/Pdl = (\rho V)_w \quad (6)$$

where

P=the perimeter of conduit 20 dl=and incremental change in the length of conduit 20 from equation 6

$$\dot{m}_w/dl = P\,(\rho V)_w = \pi(3.17 \text{ ft})(5.97/\sqrt{x}) = 59.45/\sqrt{x}$$

Assuming that this point is at the end of conduit 20, X=28 ft. and $$\dot{m}/dl = 11.23 \text{ lb/hr.-ft.}$$

The total mass of innocuous gas injected,

=(11.23 lb/hr.-ft.) (28 ft)

314 lb/hr.

This value corresponds to 4.8% the flow rate in heat stream 40.

Figure 3:
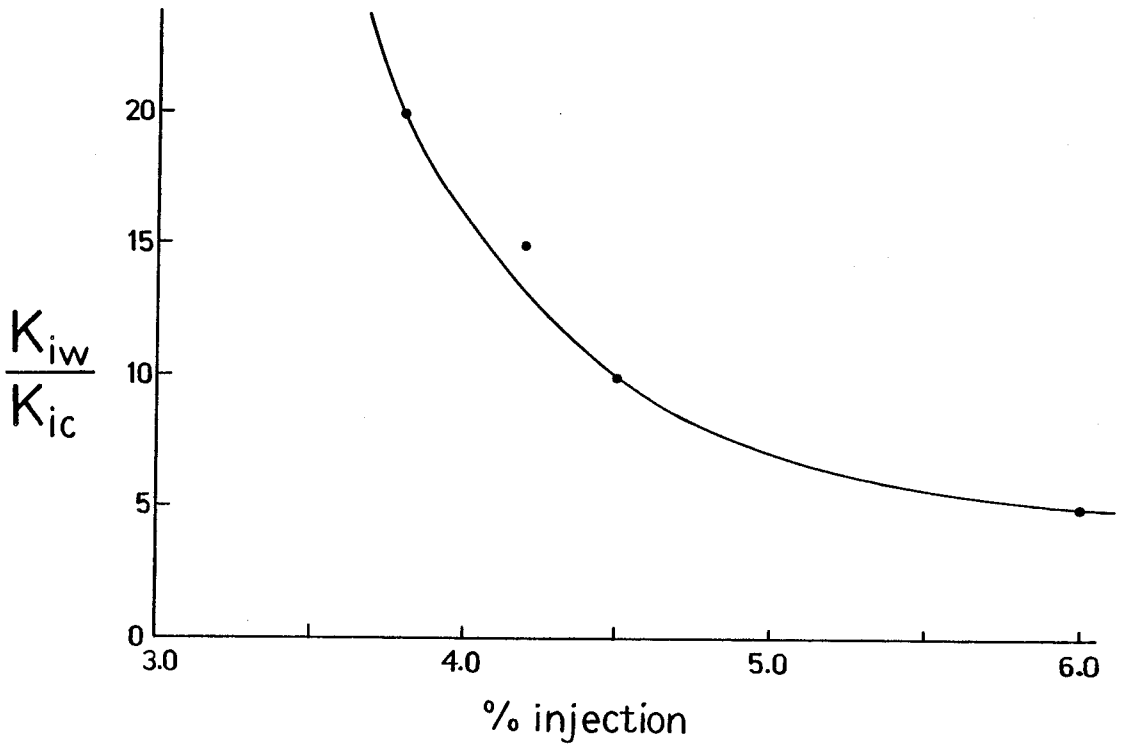
FIG. 3 is a curve of the percentage of corrosive substance at the conduit wall as a function of the percentage of injected innocuous gas relative to the corrosive heat stream.

Values for the flow rates of injected gas required for different maximum concentrations of corrosive substance at the wall are given below in TABLE 3. FIG. 3 is a curve of the percentage of corrosive substance at the conduit wall as a function of the percentage of injected gas related to the corrosive heat stream.

TABLE 3

| $K_{iw}/K_{ie}$ (%) | $\frac{(\rho V)_w}{(\rho V)_e}\sqrt{Re_{ex}}$ | $\dot{m}/dl$ | $\dot{m}$ | $\frac{\dot{m}_w}{\dot{m}_e}$ (%) |
|---|---|---|---|---|
| 20 | 0.51 | 9.55 | 267 | 3.8 |
| 15 | 0.56 | 10.48 | 294 | 4.2 |
| 10 | 0.60 | 11.23 | 315 | 4.5 |
| 5 | 0.80 | 14.98 | 419 | 6.0 |

The disclosed invention provides a low-cost heat exchanger for recovering heat from waste heat streams which would have significant deleterious effects on available heat exchangers. The boundary layer protection will allow the substitution of economical materials in heat exchangers used to recover heat from contaminated exhaust streams.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and practical application to thereby enable others skilled in the art to best utilize the invention in various embodiments and with various modification as are suited to the particular use contemplated. It is intended that the scope of the invention be defined by the claims appended hereto.

The embodiments of the invention in which an exclusive property or privilege is claimed are defined as follows:

1. A corrosive resistant heat exchanger for recovering heat from a hot gas comprising:

a first conduit for conveying said hot gas, said first conduit having ducts through the wall thereof, said ducts being spaced at predetermined intervals in the longitudinal and horizontal directions;

a second conduit surrounding said first conduit and having an outer wall spaced outwardly from the wall of said first conduit to form a plenum therebetween, said second conduit having ducts through the wall thereof;

tubes connecting the ducts in said first conduit to the ducts in the wall of said second conduit;

an innocuous gas;

means for conveying said innocuous gas through said ducts in said second conduit wall and into said first conduit, such that a boundary layer of said innocuous gas is formed between the inner surface of said first conduit and said hot gas; and means for pumping a heat recovery medium through said plenum.

2. The heat exchanger of claim 1 wherein said first and second conduits are cylindrical.

3. The heat exchanger of claim 2 wherein said ducts in said second conduit are spaced at predetermined intervals corresponding to the ducts in said first conduit.

4. A corrosive resistant heat exchanger for recovering heat from a hot gas comprising:

a conduit for conveying said hot gas, said conduit being cylindrical and forming a first cylindrical wall, and having ducts through the walls thereof, said ducts being spaced at determined intervals in the longitudinal and horizontal directions;

an innocuous gas;

means for conveying said innocuous gas through said ducts into said conduit, such that a boundary layer of said innocuous gas is formed between the inner surface of the said conduit and said hot gas; and means for recovering heat from the outer wall of said conduit, comprising;

a second cylindrical wall spaced outwardly from said conduit such that a first plenum is formed therebetween, wherein said second cylindrical wall has ducts therethrough, said ducts being spaced at predetermined intervals corresponding to the ducts in said conduit and wherein said means for conveying said innocuous gas through the ducts in said conduit comprises;

tubes connecting the ducts in said conduit to the ducts in said second cylindrical wall, and further comprising thermal insulation disposed about said tubes; and means for conveying said innocuous gas through the ducts in said second cylindrical wall.

5. The heat exchanger of claim 4 wherein said means for conveying said innocuous gas through the ducts in said second cylindrical wall comprises a third wall spaced outwardly from said second cylindrical wall forming a second plenum therebetween, said second plenum having said innocuous gas at a pressure higher than the inner pressure of said conduit.

6. The heat exchanger of claim 5 wherein said means for pumping said heat recovery gas is operable to pump said heat recovery gas in a direction parallel to the flow of said hot gas.

7. The heat exchanger of claim 5 wherein said means for pumping said heat recovery gas is operable to pump said heat recovery gas in a direction counter to the flow of said hot gas.

8. The heat exchanger of claim 5 further comprising thermal insulation disposed around said second cylindrical wall.

9. The heat exchanger of claim 1 wherein said innocuous gas is air.

10. A corrosive resistant heat exchanger for recovering heat from a hot gas comprising:

a cylindrical conduit for conveying said hot gas, said conduit forming a first cylindrical wall and said conduit having ducts at predetermined spaced intervals in the horizontal and longitudinal directions through the walls thereof;

a second cylindrical wall having ducts at predetermined spaced intervals, said ducts corresponding to the ducts in said conduit, said second cylindrical wall spaced outwardly from said first cylindrical wall such that a first plenum is formed therebetween;

tubes connecting the ducts in said conduit to the ducts in said second cylindrical wall;

an innocuous gas;

means for conveying said innocous gas through the ducts in said second cylindrical wall and into said conduit such that a boundary layer of said innocuous gas is formed between the inner surface of said conduit and said hot gas; and means for pumping a heat recovery gas through said first plenum.

11. The heat exchanger of claim 10 further comprising thermal insulation disposed around said tubes.

12. The heat exchanger of claim 11 further comprising thermal insulation disposed around said second cylindrical wall.

13. The heat exchanger of claim 12 wherein said means for conveying an innocuous gas through said ducts comprises a second plenum outside said second cylindrical wall, said second plenum having innocuous gas at a higher pressure than the inner pressure of said conduit.

14. The heat exchanger of claim 10 wherein said conduit is made of a ceramic material.

15. The heat exchanger of claim 10 wherein said conduit is made of a material from the group consisting of carbon-steel, stainless steel and metallic alloys

16. The heat exchanger of claim 10 wherein said innocuous gas is air.

* * * * *